US008207098B2

(12) United States Patent
Haramoto

(10) Patent No.: US 8,207,098 B2
(45) Date of Patent: Jun. 26, 2012

(54) LUBRICANT ADDITIVE, LUBRICANT COMPOSITION AND GREASE COMPOSITION

(75) Inventor: Yuichiro Haramoto, Kofu (JP)

(73) Assignees: Yamanashi University, Kofu-shi (JP); Balbis Co., Ltd., Ashiya-shi (JP); Nippon Chemical Industrial Co., Ltd., Tokyo (JP)

( * ) Notice: Subject to any disclaimer, the term of this patent is extended or adjusted under 35 U.S.C. 154(b) by 468 days.

(21) Appl. No.: 12/441,419

(22) PCT Filed: Sep. 10, 2007

(86) PCT No.: PCT/JP2007/068012

§ 371 (c)(1), (2), (4) Date: May 27, 2009

(87) PCT Pub. No.: WO2008/032846

PCT Pub. Date: Mar. 20, 2008

(65) Prior Publication Data

US 2009/0239773 A1 Sep. 24, 2009

(30) Foreign Application Priority Data

Sep. 15, 2006 (JP) ..... 2006-251096

(51) Int. Cl.
*C10M 133/12* (2006.01)

(52) U.S. Cl. ..... 508/243; 508/244; 508/245; 508/251; 508/252

(58) Field of Classification Search ..... 508/243, 508/244, 245, 251, 252
See application file for complete search history.

(56) References Cited

U.S. PATENT DOCUMENTS

2002/0147117 A1 10/2002 Kawata et al.
2006/0270568 A1* 11/2006 Kawata ..... 508/342

FOREIGN PATENT DOCUMENTS

| | | | | |
|---|---|---|---|---|
| JP | 2-503326 | A | | 10/1990 |
| JP | 06-128582 | A | | 5/1994 |
| JP | 07-082582 | A | | 3/1995 |
| JP | 10-53585 | A | | 2/1998 |
| JP | 10053585 | A | * | 2/1998 |
| JP | 2000-86656 | A | | 3/2000 |
| JP | 2000-86723 | A | | 3/2000 |
| JP | 2002-69472 | A | | 3/2002 |
| JP | 2004-182855 | A | | 7/2004 |
| WO | 8908136 | A1 | | 9/1989 |

OTHER PUBLICATIONS

K. Yoshitsugu et al., "Junkatsuzai to shiteno Ekisho", Journal of Japanese Society of Tribologists, 1996, pp. 506-511, vol. 41, No. 6.
International Search Report of PCT/JP2007/068012, Dec. 11, 2007.

* cited by examiner

*Primary Examiner* — Walter D Griffin
*Assistant Examiner* — Taiwo Oladapo
(74) *Attorney, Agent, or Firm* — Westerman, Hattori, Daniels & Adrian, LLP

(57) ABSTRACT

A lubricant additive comprising a rod-like liquid crystal compound possessing a cation group and an anion is disclosed. The rod-like liquid crystal compound is typically a specific type of 4-(1,3-diox-2-yl)pyridinium salt and exhibits an effect of reducing the coefficient of friction if added in a small amount. A lubricant composition and a grease composition comprising the lubricant additive are also disclosed.

9 Claims, 1 Drawing Sheet

LUBRICANT ADDITIVE, LUBRICANT COMPOSITION AND GREASE COMPOSITION

RELATED APPLICATION

This application claims priority from Japanese Patent Application No. 2006-251096, filed Sep. 15, 2006, which is incorporated by reference in its entirety.

TECHNICAL FIELD

The present invention relates to a lubricant additive, and a lubricant composition and a grease composition containing the lubricant additive.

BACKGROUND ART

Use of liquid crystals as an additive for lubricants has been studied. For example, Patent Document 1 discloses a method of simply changing a frictional force between two solid bodies by phase transfer of a thermotropic liquid crystal and the like introduced between the two bodies of relatively movable machine components. Patent Document 2 discloses a lubricant composition comprising a base oil, a liquid crystal, and a friction adjusting agent. Patent Document 3 discloses a lubricant composition containing a liquid crystal compound and a fluorinated oil. Patent Document 4 discloses a lubricant composition containing a base oil, an organic molybdenum compound, and a liquid crystal. The Patent Documents 1 to 4 describe that the friction coefficient can be reduced by adding a liquid crystal compound to a lubricant composition.

(Patent Document 1) JP-A-2-503326 (claims)
(Patent Document 2) JP-A-6-128582 (claims)
(Patent Document 3) JP-A-7-82582 (claims)
(Patent Document 4) JP-A-2004-182855 (claims)

In the methods of the Patent Documents 1 to 4, a practically useful effect of reducing the friction coefficient cannot be obtained unless the amount of the liquid crystal in the lubricant composition is 1% or more, and preferably 10% or more. However, a liquid crystal compound is a very expensive material, whereas a lubricant composition must generally be available at a low cost. The addition of a liquid crystal in an amount of 1% or more to a lubricant composition is unprofitable. This is the reason why no lubricant containing a liquid crystal compound is used in practice. There has been no lubricant composition containing an ionized liquid crystal compound.

An object of the present invention is to provide a lubricant additive which can exhibit an effect of reducing the coefficient of friction when added in a small amount, and a lubricant composition and a grease composition containing the lubricant additive.

DISCLOSURE OF THE INVENTION

The inventor of the present invention has conducted extensive studies in order to solve the above problems in general technologies. As a result, the inventor has found that (1) since a rod-like liquid crystal compound possessing a cation group and an anion has a positive (+) portion and a negative (−) portion of ions at the terminals, these positive and negative portions are specifically coordinated on the interface with a metal with ease and that the rod-like liquid crystal compound possessing a cation group and an anion forms a smectic liquid crystal phase due to the powerful vertical sequence and exists in a dark field when observed by a polarization microscope. The inventor has found that due to such characteristics, the positive (+) and negative (−) portions of ions of the rod-like liquid crystal compound possessing a cation group and an anion on the interface with a metal bond form an intermolecular sequence in which the rod-like liquid crystal compound possessing a cation group and an anion are vertically oriented and exhibit metallic interface characteristics differing from a general rod-like liquid crystal compound and that (2) for this reason, the rod-like liquid crystal compound possessing a cation group and an anion can exhibit, in practice, an effective friction reducing effect even in a very small amount. These findings have led to the completion of the present invention.

Specifically, an invention (1) of the present invention provides a lubricant additive comprising a rod-like liquid crystal compound possessing a cation group and an anion.

An invention (2) provides the lubricant additive according to the invention (1) in which the cation group is a pyridinium group or an ammonium group.

An invention (3) further provides the lubricant additive according to the invention (1) or (2) in which the rod-like liquid crystal compound is 4-(1,3-diox-2-yl)pyridinium salt-type rod-like liquid crystal compound shown by the following formula (6):

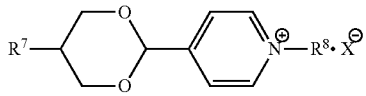

(6)

wherein $R^7$ and $R^8$ indicate alkyl groups, alkoxyl groups, or a group having an unsaturated bond shown by the following formula (4), and X represents a halogen atom,

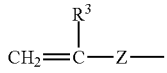

(4)

wherein $R^3$ represents a hydrogen atom or a methyl group, Z indicates $—(CH_2)_m—$, $—(CH_2)_m—O—$, $—CO—O—(CH_2)_m—$, $—CO—O—(CH_2)_m—O—$, $—C_6H_4—CH_2—O—$, or —CO—, wherein m is an integer of 1 to 30.

An invention (4) provides the lubricant additive according to the invention (3), wherein $R^7$ and $R^8$ in the formula (6) are alkyl groups.

An invention (5) provides the lubricant additive according to the invention (4), wherein $R^7$ in the formula (6) is an alkyl group having 8 to 22 carbon atoms and $R^8$ is an alkyl group having 1 to 4 carbon atoms.

An invention (6) provides a lubricant composition comprising the lubricant additive according to any one of the inventions (1) to (5).

An invention (7) provides the lubricant composition according to the invention (6), wherein the content of the lubricant additive is 0.0001 to 0.1 mass %.

An invention (8) provides a grease composition comprising the lubricant additive according to any one of the inventions (1) to (5).

An invention (9) provides the grease composition according to the invention (8), wherein the content of the lubricant additive is 0.0001 to 0.1 mass %.

An invention (10) provides a grease composition comprising the lubricant composition according to the invention (6) or (7) and a thickener.

The lubricant additive of the present invention can reduce the friction coefficient when added in a small amount. Since the lubricant additive of the present invention is an ionized liquid crystal compound, the boiling point of the lubricant composition is increased if the lubricant additive is added in a small amount. Thus, the effects of controlling vaporization and lowering the coagulation temperature of the lubricant composition can also be expected. The lubricant composition and the grease composition containing the lubricant additive of the present invention are useful for lubricating vehicle components such as continuously variable transmissions, manual or automatic transmissions, engines, gears, and power steering, for lubricating internal combustion engines, machine tools, and the like, and for lubricating motors and sliding parts of precision mechanical equipment such as a computer hard disk, information recording media such as a tape and a card, and a cellular phone.

BEST MODE FOR CARRYING OUT THE INVENTION

Figure 1:
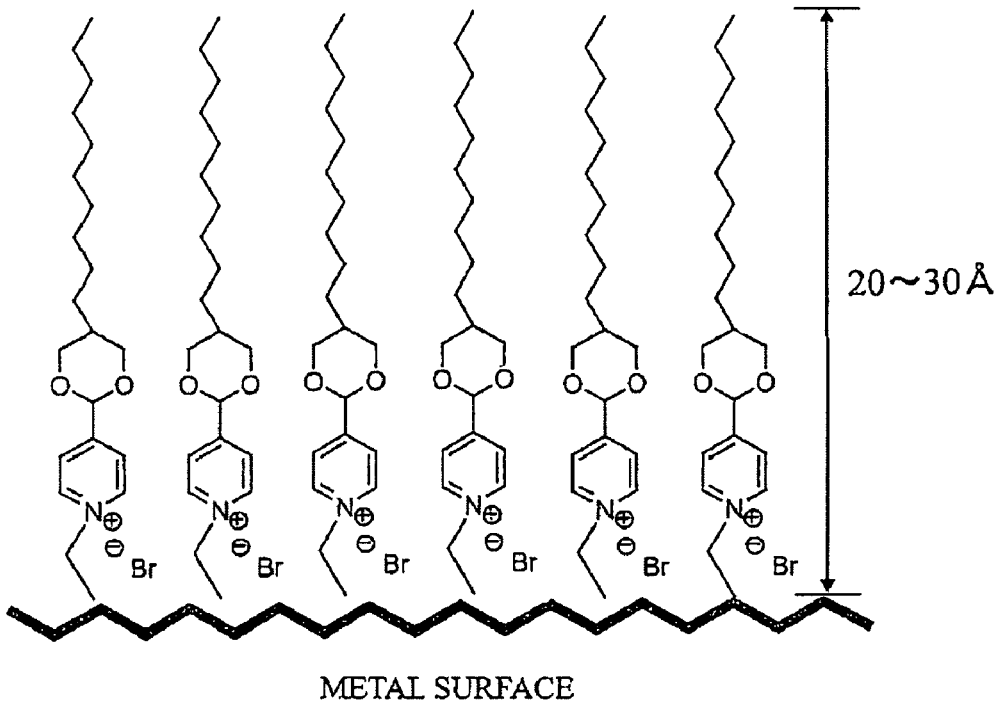
FIG. 1 shows the state of the lubricant additive of the present invention on a metal surface and FIG. 2 shows the change of the friction coefficient over time in Example 3, Example 4, and Comparative Example 1.

The lubricant additive of the present invention is a rod-like liquid crystal compound possessing a cation group and an anion. Specifically, the lubricant additive of the present invention is a rod-like liquid crystal compound and the rod-like liquid crystal compound has a cation group and an anion in the molecule.

The rod-like liquid crystal compound used as the lubricant additive of the present invention is a compound which forms a liquid crystal state and changes its state from solid to crystal and crystal to liquid according to a temperature change (such a compound hereinafter referred to as a liquid crystal compound). A liquid crystal compound which changes its state from solid to crystal and crystal to liquid according to a temperature change in this manner is also called a thermotropic liquid crystal. A liquid crystal means an anisotropic liquid which is fluid, is optically anisotropic, and shows birefringence. The state of liquid crystal is between liquid and crystal.

There are mainly two types of liquid crystal compounds which can form the state of liquid crystals. One is a compound which has a rod-like molecular shape called a calamitic liquid crystal and the other is a compound which has a disk-like molecular shape called a discotic liquid crystal. Among these, the rod-like liquid crystal compound used as the lubricant additive of the present invention is a compound having a rod-like molecular shape called a calamitic liquid crystal.

The rod-like liquid crystal compound used as the lubricant additive of the present invention may be either a nematic liquid crystal or a smectic liquid crystal.

The rod-like liquid crystal compound used as the lubricant additive in the present invention possesses a cation group and a counter anion to the cation group in one molecule. Specifically, the rod-like liquid crystal compound used as the lubricant additive in the present invention is a salt having a cation group bonded to the molecule and an anion bonded to the cation by an ionic bond.

The cation group in the lubricant additive of the present invention is not particularly limited. Examples include a sulfonium group, a phosphonium group, an ammonium group, a serenonium group, an arsonium group, a stibonium group, a stanonium group, an iodonium group, and a nitrogen-containing heterocyclic quaternary base. As the nitrogen-containing heterocyclic quaternary base, a pyridinium group, an imidazolium group, a thiozolium group, an oxazolium group, a pyradinium group, a pyrimidinium group, and the like can be given. The nitrogen-containing heterocyclic quaternary base may be substituted with a hetero atom such as an oxygen atom and a sulfur atom, and may form a ring. Of these, the pyridinium group or the ammonium group is preferable. Although there are no particular limitations to the valence number of the cation group in the lubricant additive of the present invention, a monovalent cation group is preferable. That is to say, as the rod-like liquid crystal compound used as the lubricant additive of the present invention, a pyridinium salt or an ammonium salt is preferable.

There are no specific limitations to the anion in the lubricant additive of the present invention. Halogen ions such as a chlorine ion, a bromine ion, and an iodine ion, anions of organic acids, anions of inorganic acids, and the like can be given. Specific examples of the anions of organic acids include anions of aliphatic monocarboxylic acids such as formic acid, acetic acid, propionic acid, butyric acid, valeric acid, caproic acid, enanthic acid, caprylic acid, pelargonic acid, capric acid, undecanoic acid, lauric acid, tridecanoic acid, myristic acid, pentadecanoic acid, palmitic acid, heptadecanoic acid, stearic acid, nonadecanoic acid, arachidic acid, isobutyric acid, pivalic acid, isovaleric acid, isocaproic acid, 2-ethylbutyric acid, 3,3-dimethylbutyric acid, isocaprylic acid, 2-ethylhexanoic acid, isocapric acid, acrylic acid, methacrylic acid, crotonic acid, isocrotonic acid, 3-butenic acid, pentenic acid, hexenic acid, heptenic acid, octenic acid, nonenic acid, decenic acid, undecenic acid, dodecenic acid, oleic acid, linolic acid, linoleic acid, elaidic acid, 2-methylcrotonic acid, 3-methylcrotonic acid, tiglic acid, cinnamic acid, cyclopropanecarboxylic acid, cyclobutanecarboxylic acid, cyclopentanecarboxylic acid, cyclohexanecarboxylic acid, trichloroacetic acid, tribromoacetic acid, trifluoroacetic acid, phenylacetic acid, glycolic acid, and lactic acid; aliphatic polyvalent carboxylic acids such as oxalic acid, malonic acid, succinic acid, glutaric acid, adipic acid, pimelic acid, suberic acid, azelaic acid, sebacic acid, dodecanoic diacid, maleic acid, fumaric acid, citraconic acid, itaconic acid, monomethyl maleic acid, malic acid, glutamic acid, tartaric acid, and citric acid; aromatic monocarboxylic acids such as benzoic acid, toluic acid, ethylbenzoic acid, propylbenzoic acid, butylbenzoic acid, hydroxybenzoic acid, anisic acid, ethoxybenzoic acid, propoxybenzoic acid, butoxybenzoic acid, aminobenzoic acid, N,N-dimethylaminobenzoic acid, nitrobenzoic acid, fluorobenzoic acid, resorcinic acid, and cinnamic acid; aromatic polyvalent carboxylic acids such as phthalic acid, isophthalic acid, terephthalic acid, trimellitic acid, trimesic acid, and pyromellitic acid; carbolic acids such as phenol, o-phenylphenol, p-aminophenol, p-nitrophenol, catechol, resorcin, β-naphtol, and 2-chlorophenol. As specific examples of the anion of inorganic acid, anions of sulfuric acid, sulfurous acid, amidosulfuric acid, methanesulfonic acid, ethanesulfonic acid, propanesulfonic acid, butanesulfonic acid, benzenesulfonic acid, p-toluenesulfonic acid, perchloric acid, periodic acid, ortho-periodic acid, permanganic acid, nitric acid, nitrous acid, phosphoric acid, phosphorous acid, hypophosphorous acid, arsenic acid, arsenous acid, boric acid, fluoroboric acid, hexafluorophosphoric acid, hexafluoroantimonic acid, hexafluroroarsenic acid, chromic acid, hydrochloric acid, chlorous acid, hypochloric acid, selenic acid, selenious acid, cyanic acid, thiocyanic acid, telluric acid, tellurious acid, silicic acid, silic hydrofluoric acid, hexafluorosilicic acid, polyphosphoric acid, meta-phosphoric acid, molybdic acid, and the like can be given. Of these, a chlorine ion, bromine ion, or iodine ion is preferable. The valence number of the anion in the lubricant additive of the present invention is equivalent to or smaller than the number of valence of the cation group.

Among the rod-like liquid crystal compounds used as the lubricant additive of the present invention, preferable compounds include a pyridinium salt rod-like liquid crystal compound of the following formula (1), (1)

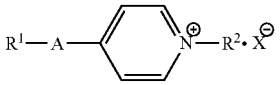

a pyridinium salt rod-like liquid crystal compound of the following formula (2), and (2)

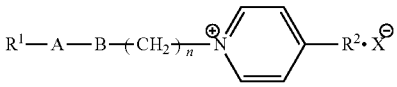

a pyridinium salt rod-like liquid crystal compound of the following formula (3).

(3)

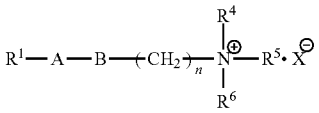

In the above formula (1), formula (2), and formula (3), $R^1$ and $R^2$ may be either the same or different, and each independently represents an alkyl group, an alkoxyl group, or an unsaturated bond shown by the following formula (4).

(4)

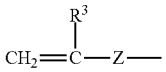

The alkyl group represented by $R^1$ and $R^2$ is a linear or branched alkyl group. The number of carbon atoms in the alkyl group represented by $R^1$ or $R^2$ is preferably 1 to 30, and particularly preferably 1 to 22. As specific examples of the all group represented by $R^1$ and $R^2$, a methyl group, an ethyl group, a butyl group, a pentyl group, a hexyl group, an octyl group, a dodecyl group, a pentadecyl group, and an octadecyl group can be given.

The alkoxyl group represented by $R^1$ and $R^2$ is a linear or branched alkoxyl group. A preferable alkoxyl group represented by $R^1$ and $R^2$ is a group shown by the following formula (5), $$C_pH_{(2p+1)}O— \quad (5)$$

wherein p is preferably an integer of 1 to 30, and particularly preferably 1 to 22.

In the above formula (4) which shows $R^1$ and $R^2$ in the formula (1), (2), or (3), $R^3$ indicates a hydrogen atom or a methyl group, and Z indicates $—(CH_2)_m—$, $—(CH_2)_m—O—$, $—CO—O—(CH_2)_m—$, $—CO—O—(CH_2)_m—O—$, $—C_6H_4—CH_2—O—$, or —CO—, wherein m is an integer of 1 to 30, and preferably an integer of 1 to 22.

In the above formulas (1), (2), and (3), A indicates a divalent group represented by the following formulas (A-1) to (A-14).

(A-1)

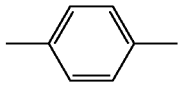

(A-2)

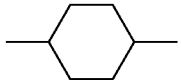

(A-3)

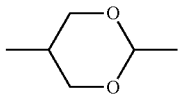

(A-4)

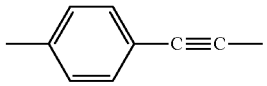

(A-5)

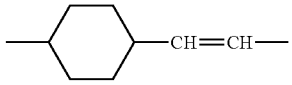

(A-6)

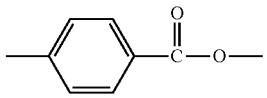

(A-7)

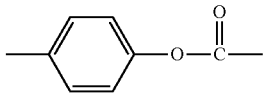

(A-8)

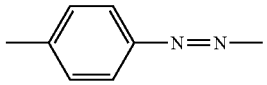

(A-9)

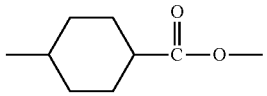

(A-10)

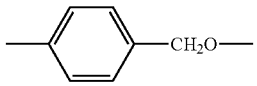

(A-11)

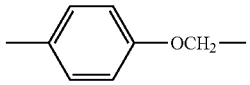

(A-12)

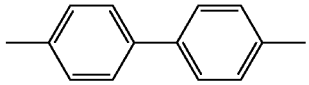

(A-13)

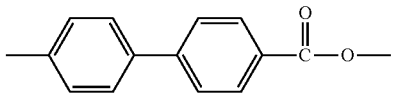

(A-14)

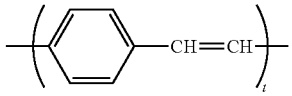

In the formula (A-14), t is an integer of 1 to 5.

In the above formulas (2) and (3), B indicates a divalent group represented by the following formulas (B-1) to (B-11).

(B-1)

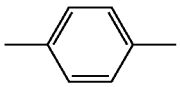

(B-2)

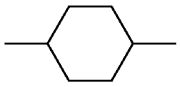

(B-3)

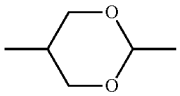

(B-4)

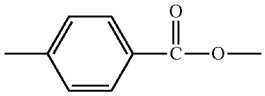

(B-5)

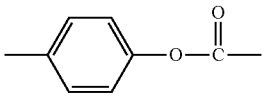

(B-6)

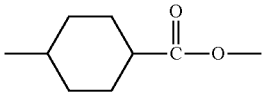

(B-7)

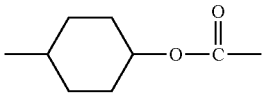

(B-8)

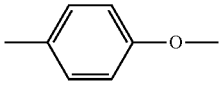

(B-9)

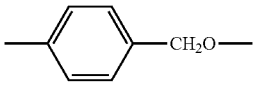

(B-10)

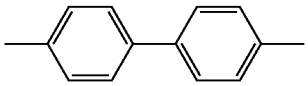

(B-11)

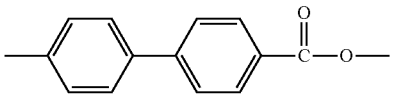

In the above formulas (2) and (3), n is an integer of 0 to 20. $R^4$, $R^5$ and $R^6$ in the above formula (3) indicate alkyl groups having 1 to 10 carbon atoms. $X^-$ in the above formulas (1) to (3) represents a halogen ion, and particularly preferably a chlorine ion, a bromine ion, or an iodine ion.

Among the rod-like liquid crystal compounds used as the lubricant additive of the present invention, a particularly preferable compound is the pyridinium salt rod-like liquid crystal compounds shown by the above formula (1). Among the pyridinium salt rod-like liquid crystal compounds shown by the above formula (1), a pyridinium salt rod-like liquid crystal compound in which A is a divalent group shown by the formula (A-3), that is, 4-(1,3-diox-2-yl)pyridinium salt rod-like liquid crystal compound shown by the following formula (6), is particularly preferable.

(6)

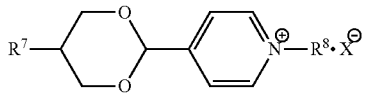

The 4-(1,3-diox-2-yl)pyridinium salt rod-like liquid crystal compound shown by the above formula (6) is hereinafter referred to from time to time as the pyridinium salt-type rod-like liquid crystal compound shown by the above formula (6).

In the above formula (6), $R^7$ and $R^8$ indicate alkyl groups, alkoxyl groups, or a group having an unsaturated bond shown by the above formula (4). $R^7$ and $R^8$ may be either the same or different groups.

The alkyl group represented by $R^7$ and $R^8$ is a linear or branched alkyl group. The number of carbon atoms in the alkyl group represented by $R^7$ and $R^9$ is preferably 1 to 30, and particularly preferably 1 to 22. As specific examples of the alkyl group represented by $R^7$ and $R^8$, a methyl group, an ethyl group, a butyl group, a pentyl group, a hexyl group, an octyl group, a dodecyl group, a pentadecyl group, and an octadecyl group can be given. The alkoxyl group represented by $R^7$ or $R^8$ is a linear or branched alkoxyl group, preferably a linear or branched alkoxyl group shown by the above formula (5) in which p is an integer of 1 to 30, and particularly preferably 1 to 22. The previous description of the group having the unsaturated bond represented by $R^1$ and $R^2$ in the above formula (4) applies to the unsaturated bond represented by $R^7$ and $R^8$ in the above formula (4).

$X^-$ in the above formula (6) represents a halogen ion, and particularly preferably a chlorine ion, a bromine ion, or an iodine ion.

Among the pyridinium salt-type rod-like liquid crystal compounds shown by the above formula (6), pyridinium salt-type rod-like liquid crystal compounds shown by the above formula (6) in which $R^7$ is an alkyl group are preferable due to their excellent effect of reducing the coefficient of friction. A pyridinium salt-type rod-like liquid crystal compound having an alkyl group with 1 to 30 carbon atoms as $R^7$ in the formula (6) is particularly preferable, a pyridinium salt-type rod-like liquid crystal compound having an alkyl group with 5 to 22 carbon atoms as $R^7$ in the formula (6) is more preferable, and a pyridinium salt-type rod-like liquid crystal compound having an alkyl group with 8 to 22 carbon atoms as $R^7$ and an alkyl group with 1 to 4 carbon atoms as $R^8$ in the formula (6) is still more preferable.

These rod-like liquid crystal compounds may be used either individually or in combination of two or more as the lubricant additive of the present invention.

The pyridinium salt-type rod-like liquid crystal compounds shown by the formula (6) can be synthesized according to the reaction of the following reaction formula (7), for example.

(7)

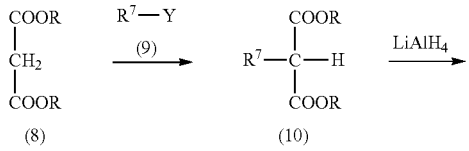

-continued

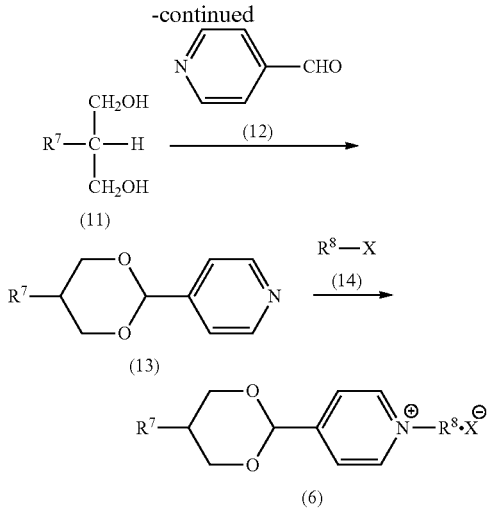

First, a malonic ester (8) and a halide (9) are reacted to obtain an $R^7$-introduced malonate (10), which is reduced with $LiAlH_4$ to obtain an $R^7$-introduced 1,3-propanediol (11). The $R^7$-introduced 1,3-propanediol (11) is then reacted with pyridine-4-aldehyde (12) to obtain $R^7$-introduced 4-(1,3-diox-2-yl)pyridine (13). Next, the $R^7$-introduced 4-(1,3-diox-2-yl) pyridine (13) is reacted with a halide (14) to obtain a pyridinium salt-type rod-like liquid crystal compound shown by the above formula (6) (see, for example, JP-A-10-53585, JP-A-2000-86723, JP-A-2000-86656, and "Liquid Crystals" Vol. 26, No. 10, pp 1425-1428 (1999)). $R^7$, $R^8$, and X in the formula (7) are the same as the $R^7$, $R^8$, and X in the formula (6), and Y indicates a halogen atom.

As shown in the following formula (15), the pyridinium salt-type rod-like-liquid crystal compound shown by the above formula (1) can be obtained by reacting a pyridine compound (16) and a halide (17). $R^1$, $R^2$, X, and A in the following formula (15) are the same as those in the above formula (1).

(15)

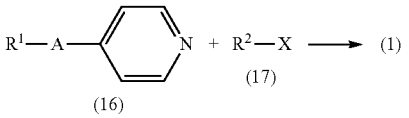

The pyridinium salt-type rod-like liquid crystal compound shown by the above formula (2) can be obtained by reacting a halide (19) and a pyridine compound (20) as shown by the following reaction formula (18). $R^1$, $R^2$, X, A, B, and n in the following formula (18) are the same as those in the above formula (2).

(18)

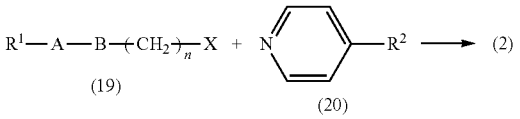

The ammonium salt-type rod-like liquid crystal compound shown by the above formula (3) can be obtained by reacting a halide (19) and a tertiary amine compound (22) as shown by the following reaction formula (21). $R^1$, $R^4$, $R^5$, $R^6$, X, A, B, and n in the following formula (21) are the same as those in the above formula (3).

(21)

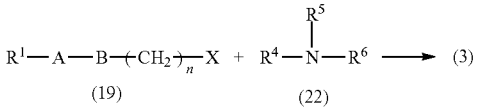

The reactions in the above formulas (15), (18), and (21) are commonly known reactions as described in WO 2004/085398 and WO 2004/085380, for example.

The lubricant composition of the present invention comprises the lubricant additive of the present invention. That is, the composition comprises a rod-like liquid crystal compound possessing a cation group and an anion.

The lubricant composition of the present invention is produced by adding the rod-like liquid crystal compound possessing a cation group and an anion and various additives which are optionally added to a lubricating base material. That is, the lubricant composition of the present invention comprises a lubricating base material and additives which include the lubricant additive of the present invention as an essential component.

Either one type of the lubricant additive of the present invention or a combination of two or more lubricant additives of the present invention may be used in the lubricant composition of the present invention.

The lubricating base material to which the lubricant additive of the present invention is added may be a mineral oil, a synthetic oil, or a mixture of these. When the lubricant composition of the present invention is an aqueous composition, water may be used as a base material.

There are no specific limitations to these lubricating base oils. Any materials, including mineral materials and synthetic materials, commonly used as a lubricating base oil can be used without regard to their origin. Examples of the mineral lubricating base oils include paraffinic or naphthenic hydrocarbon oils or mixtures of the hydrocarbon oils obtained from lubricating oil fractions of atmospheric or vacuum distillation of a crude oil using various refining processes such as solvent deasphalting, solvent extraction, hydrocracking, solvent dewaxing, contact dewaxing, hydrofinishing, sulfuric acid washing, and clay treatment, or a combination of these processes. As examples of the synthetic lubricating base oil, poly-α-olefin, polyesters such as diester, polyol ester, and trimellitic acid ester, phosphate, alkylbenzene and alkyl naphthalene, polyoxyalkylene glycol, silicone oil, fluorine oil, alkyl phenyl ether oil, alkyl biphenyl oil, and polyphenyl ether oil can be given.

Poly-α-olefin used as the synthetic lubricating base oil is a homopolymer or a copolymer of a branched or non-branched olefin hydrocarbon having 2 to 14 carbon atoms, preferably 4 to 12 carbon atoms. The poly-α-olefin used as the synthetic lubricating base oil is preferably an oligomer having an average molecular weight from 100 to about 2000, preferably from 200 to about 1000, in particular the oligomer in which the unsaturated bonds are hydrogenated. As examples of preferable poly-α-olefins, polybutene, α-olefin oligomer, ethylene-α-olefin oligomer, 1-octene oligomer, and 1-decene oligomer can be given. As the polybutene, a copolymer obtained by copolymerization of a monomer mixture which contains isobutene, as a major component, and butane-1 and butane-2, for example, is preferable. As examples of the α-olefin oligomer, a copolymer of α-olefins having 6 to 12 carbon atoms which are obtained by thermal cracking of hydrocarbons, or by trimerization, tetramerization, pentamerization, or hexamerization of lower olefins can be given. An oligomer obtained from a single monomer such as decene is also preferable.

The poly-α-olefin oligomers can be produced by using a Friedel Crafts catalyst such as aluminium chloride and boron fluoride, a Ziegler catalyst, an oxide catalyst such as chromium oxide, and the like. Hydrogenation of the poly-α-olefin oligomers is carried out by causing the reaction product from which the catalyst has been removed to come in contact with a hydrogenation catalyst such as a nickel-molybdenum alumina catalyst while heating under pressure.

As the diester used as the synthetic lubricating base oil, diesters obtained by reacting an aliphatic dibasic acid having 4 to 14 carbon atoms or an aromatic dibasic acid with an aliphatic alcohol having 4 to 14 carbon atoms can be given. Examples of such diesters include dioctyl adipate, di-(1-ethylpropyl)adipate, di-(3-methylbutyl)adipate, di-(1,3-dimethylbutyl)adipate, di-(2-ethylbutyl)adipate, di-(2-ethylhexyl) adipate, di-(isooctyl)adipate, di-(isononyl)adipate, di-(3,5,5-trimethylhexyl)adipate, di-(isodecyl)adipate, di-(undecyl) adipate, di-(tridecyl)adipate, di-(isotetradecyl)adipate, di-(2,2,4-trimethylpentyl)adipate, di-[mixed(2-ethylhexyl, isononyl)]adipate, di-(1-ethylpropyl)azelate, di-(2-ethylbutyl)azelate, di-(2-ethylhexyl)azelate, di-(isooctyl)azelate, di-(isononyl)azelate, di-(3,5,5 trimethylhexyl)azelate, di-(isodecyl)azelate, di-(tridecyl)azelate, di-[mixed(2-ethylhexyl, isononyl)]azelate, di-[mixed(2-ethylhexyl, decyl)]azelate, di-[mixed(2-ethylhexyl, isodecyl)]azelate, di-[mixed(2-ethylhexyl, 2-propylheptyl)]azelate, di-[mixed(2-ethylhexyl, decyl)]azelate, di-(n-butyl)sebacate, di-(isobutyl)sebacate, di-(1-ethylpropyl)sebacate, di-(3-methylbutyl)sebacate, di-(1,3-dimethylbutyl)sebacate, di-(2-ethylbutyl)sebacate, di-(2-ethylhexyl)sebacate, di-[2-(2'-ethylbutoxy)ethyl]sebacate, di-(2,2,4-trimethylpentyl)sebacate, di-(isononyl) sebacate, di-(3,5,5-trimethylhexyl) sebacate, di-(isodecyl) sebacate, di-(isoundecyl) sebacate, di-(tridecyl)sebacate, di-(isotetradecyl)sebacate, di-[mixed(2-ethylhexyl, isononyl)] sebacate, di-(2-ethylhexyl)glutalate, di-(isoundecyl) glutalate, di-(isotetradecyl)glutalate, di-n-butyl phthalate, di-n-hexyl phthalate, di-n-heptyl phthalate, di-n-octyl phthalate, di-2-ethylhexyl phthalate, diisononyl phthalate, octyldecyl phthalate, diisodecyl phthalate, and ditridecyl phthalate.

The polyol ester used as the synthetic lubricating base oil can be obtained by reacting a neopentyl polyol having 5 to 9 carbon atoms such as neopentyl glycol (NPG), trimethylolpropane (TMP) or pentaerythritol (PE) with an organic acid having 4 to 18 carbon atoms. Specific examples of such a polyol ester include NPG.di-(heptanoate), NPG.di-(2-ethylbutylate), NPG.di-(cyclohexanoate), NPG.di-(heptanoate), NPG.di-(isoheptanoate), NPG.di-(octanoate), NPG.di-(2-ethylhexanoate), NPG.di-(isooctanoate), NPG.di-(isononanoate), NPG.di-(isodecanoate), NPG.di-{mixed (hexanoate, heptanoate)}, NPG.di-{mixed(hexanoate, octanoate)}, NPG.di-{mixed(hexanoate, nonanoate)}, NPG.di-{mixed(heptanoate, octanoate)}, NPG.di-{mixed (heptanoate, nonanoate)}, NPG.di-{mixed(heptanoate, isooctanoate)}, NPG.di-{mixed(heptanoate, isononanoate)}, NPG.di-{mixed(isooctanoate, isononanoate)}, NPG.di-{mixed(butanoate, tridecanoate)}, NPG.di-{mixed(butanoate, tetradecanoate)}, NPG.di-{Mixed(butanoate, hexadecanoate)}, NPG.di-{mixed(butanoate, octadecanoate)}, NPG.di-{mixed(hexanoate, isooctanoate, isononanoate)}, NPG.di-{mixed(hexanoate, isooctanoate, isodecanoate)}, NPG.di-{mixed(heptanoate, isooctanoate, isononanoate)}, NPG.di-{mixed(heptanoate, isooctanoate, isodecanoate)}, NPG.di-{mixed(octanoate, isononanoate, isodecanoate)}, TMP.tri-(pentanoate), TMP.tri-(hexanoate), TMP.tri-(heptanoate), TMP.tri-(octanoate), TMP.tri-(nonanoate), TMP.tri-(isopentanoate), TMP.tri-(2-ethyl butyrate), TMP.tri-(isopentanoate), TMP.tri-(isooctanoate), TMP.tri-(2-ethyl hexanoate), TMP.tri-(isononanoate), TMP.tri-(isodecanoate), TMP.tri-[mixed(butyrate, octadecanoate)], TMP.tri-[mixed (hexanoate, hexadecanoate)], TMP.tri-[mixed(heptanoate, tridecanoate)], TMP.tri-[mixed(octanoate, decanoate)], TMP.tri-[mixed(octanoate, nonanoate)], TMP.tri-[mixed(butyrate, heptanoate, octadecanoate)], TMP.tri-[mixed(pentanoate, heptanoate, tridecanoate)], TMP.tri-[mixed(hexanoate, heptanoate, octanoate)], TMP.trinonanoate, TMP.tri-[mixed(heptanoate, nonanoate)], TMP.tri-[mixed (heptanoate, octanoate, nonanoate)], PE.tetra(pentanoate), PE.tetra(hexanoate), PE.tetra(isopentanoate), PE.tetra(2-ethyl butyrate), PE.tetra(heptanoate), PE.tetra(isoheptanoate), PE.tetra(isooctanoate), PE.tetra(2-ethylhexanoate), PE.tetra(nonanoate), PE.tetra(isononanoate), and esters of PE and a linear of branched carboxylic acid having 4 to 9 carbon atoms.

The polyol esters used as the synthetic lubricating base oil also include polyol esters obtained by reacting a neopentyl polyol other than NPG, TMP, and PE such as 2-methyl-2-propylpropane-1,3-diol, 2,2-diethylpropanediol, trimethylolethane, and trimethylolhexane with an organic acid or a mixture of organic acids.

As the phosphate used as the synthetic lubricating base oil, tricresyl phosphate, cresyldiphenyl phosphate, propylphenyl diphenyl phosphate, dipropylphenyl phenyl phosphate, tripropyl phosphate, dibutylphenyl phenyl phosphate, butylphenyl diphenyl phosphate, tributylphenyl phosphate, tri-(2-ethylhexyl)phosphate, trialkylphenyl phosphate, and alkylphenyl phenyl phosphate can be given.

The alkyl benzene or alkyl naphthalene used as the synthetic lubricating base oil are oil components containing dialkylated aromatic hydrocarbons as major components, which are obtained by alkylating aromatic hydrocarbons such as benzene, toluene, or naphthalene with a branched or linear α-olefin using a catalyst such as hydrogen fluoride, sulfuric acid, or aluminium chloride. Either linear or branched alkyl groups mainly having 12 carbon atoms can be used for the alkylation.

The polyoxyalkylene glycol used as the synthetic lubricating base oil is a ring-open polymer of a linear or branched alkylene oxide having 2 to 5, preferably 2 or 3 carbon atoms in the alkylene group. As the alkylene oxide, ethylene oxide, propylene oxide, butylene oxide, or a mixture of these, preferably propylene oxide is used. Accordingly, preferable polyoxyalkylene glycols are polyethylene glycol and polypropylene glycol, having a molecular weight in a range of 100 to 2000, and preferably 200 to 1000. Polyoxyalkylene glycols having an alkyl group on both ends, and polyoxyalkylene glycols having an alkyl group on one end and a hydroxyl group on the other end are included. The number of carbon atoms in the alkyl group is usually 1 to 18.

The lubricating base oil used in the present invention may be a mixture of two or more mineral lubricating base oils, a mixture of two or more synthetic lubricating base oils, or a mixture of a mineral lubricating base oil and a synthetic lubricating base oil. The ratio of the two or more lubricating base oils may be arbitrarily selected. Although there are no particular limitations to the viscosity of the lubricating base oil used in the lubricant composition of the present invention, the lubricating base oil has a kinematic viscosity at 40° C. of preferably 1 to 1000 $mm^2/s$, and more preferably 5 to 800 $mm^2/s$.

The content of the lubricant additive of the present invention in the lubricant composition is 0.0001 to 0.1 mass %, and preferably 0.0008 to 0.08 mass %. If the content of the lubricant additive in the lubricant composition is less than 0.0001 mass %, the effect of addition is too small for the lubricant composition to have a practical coefficient of friction; if more than 0.1 mass %, on the other hand, the coefficient of friction tends to be excessively high.

In addition to the lubricant additive of the present invention, the lubricant composition may contain a friction conditioner such as a wear inhibitor, an extreme pressure additive, and an oiliness agent, or other additives, as required.

As examples of the extreme pressure additive and the wear inhibitor, sulfur compounds, phosphorus compounds, and molybdenum compounds can be given.

As examples of the sulfur compounds used as the extreme pressure additive or the wear inhibitor, disulfides, olefin sulfides, and sulfurated oils and fats can be given. More specific examples of the sulfur compounds used as the extreme pressure additive or the wear inhibitor include a compound shown by the formula $(RO)_3P{=}S$ (wherein R represents an alkyl group, an allyl group, or a phenyl group, and two or three Rs may be the same or different) such as trialkyl phosphorothionate, triphenyl phosphorothionate, and alkyl diallyl phosphorothionate; olefin sulfides shown by the formula $R^9$-Sx-$R^{10}$ (wherein x indicates an integer of 1 to 8, $R^9$ and $R^{10}$ represents an alkyl group, alkenyl group, aryl group, or aralkyl group having 4 to 12 carbon atoms) such as diisobutyl disulfide, dioctyl polysulfide, di-t-nonyl polysulfide, di-t-butyl polysulfide, dibenzyl polysulfide, diphenyl sulfide, and diphenyl disulfide; sulfurated olefins obtained by sulfurizing olefins such as polyisobutylene or terpenes using a sulfurizing agent such as sulfur; sulfurated oils and fats such as sulfurated sperm oil and sulfurated dipentene; thiocarbonates such as xanthic disulfide; and zinc dithiophosphate additives such as primary alkyl zinc dithiophosphate, secondary alkyl zinc dithiophosphate, alkyl-allyl zinc dithiophosphate, and allyl zinc dithiophosphate.

As examples of the phosphorous compounds used as the extreme pressure additive or the wear inhibitor, phosphoric acid monoesters, phosphoric acid diesters, phosphoric acid triesters, phosphorous acid monoesters, phosphorous acid diesters, phosphorous acid triesters, and amine salts or alkanol amine salts of these esters can be given. Specific examples of the phosphorous compounds used as the extreme pressure additive or the wear inhibitor include phosphates such as benzyl diphenyl phosphate, allyl diphenyl phosphate, triphenyl phosphate, tricresyl phosphate, ethyl diphenyl phosphate, tributyl phosphate, dibutyl phosphate, cresyl diphenyl phosphate, dicresyl phenyl phosphate, ethylphenyl diphenyl phosphate, diethylphenyl phenyl phosphate, propylphenyl diphenyl phosphate, dipropyl phenyl phenyl phosphate, triethyl phenyl phosphate, tripropyl phenyl phosphate, butylphenyl diphenyl phosphate, dibutylphenyl phenyl phosphate, and tributyl phenyl phosphate; phosphite such as triisopropyl phosphite and diisopropyl phosphite; hexamethyl phosphoric triamide, n-butyl-n-dioctyl phosphinate, di-n-butylhexyl phosphonate, amine dibutyl phosphonate, and dibutyl phosphoroamidate.

As examples of the molybdenum compounds used as the extreme pressure additive or the wear inhibitor, inorganic molybdenum compounds and organic molybdenum compounds can be given. Specific examples of the inorganic molybdenum compounds used as the extreme pressure additive or the wear inhibitor include metal molybdates such as sodium molybdate, potassium molybdate, lithium molybdate, magnesium molybdate, calcium molybdate, copper molybdate, zinc molybdate, and barium molybdate, and molybdenum disulfide. As specific examples of the organic molybdenum compounds used as the extreme pressure additive or the wear inhibitor, molybdenum dialkyl dithiocarbamate (MoDTC), molybdenum dialkyl dithiophosphate (MoDTP), and molybdenum amine can be given. Of these, molybdenum dialkyl dithiocarbamate is preferable. Specific examples of the molybdenum dialkyldithiocarbamate include molybdenum dibutyldithiocarbamate sulfide, molybdenum dipentyldithiocarbamate sulfide, molybdenum dihexyldithiocarbamate sulfide, molybdenum diheptyldithiocarbamate sulfide, molybdenum dioctyldithiocarbamate sulfide, molybdenum dinonyldithiocarbamate sulfide, molybdenum didecyldithiocarbamate sulfide, molybdenum diundecyldithiocarbamate sulfide, molybdenum didodecyldithiocarbamate, molybdenum ditridecyldithiocarbamate, molybdenum dibutyldithiocarbamate oxysulfide, molybdenum dipentyldithiocarbamate oxysulfide, molybdenum dihexyldithiocarbamate oxysulfide, molybdenum diheptyldithiocarbamate oxysulfide, molybdenum dioctyldithiocarbamate oxysulfide, molybdenum dinonyldithiocarbamate oxysulfide, molybdenum didecyldithiocarbamate oxysulfide, molybdenum diundecyldithiocarbamate oxysulfide, molybdenum didodecyldithiocarbamate oxysulfide, and molybdenum ditridecyldithiocarbamate oxysulfide.

The above sulfur compounds, zinc dithiophosphates, phosphorus compounds, and molybdenum compounds may be used either individually of in combination of two or more.

As examples of the oiliness agents, aliphatic monocarboxylic acids such as caprylic acid, lauric acid, myristic acid, palmitic acid, stearic acid, and oleic acid; aliphatic dicarboxylic acids such as adipic acid, pimelic acid, suberic acid, azelaic acid, sebacic acid, undecanoic diacid, dodecanoic diacid, brassylic acid, tetradecanoic diacid, and other aliphatic dicarboxylic acids having 15 to 30 carbon atoms; esters of aliphatic (di)carboxylic acids, aliphatic alcohol, aliphatic amine, aliphatic amine salt, and fatty acid amides can be given.

These oiliness agents may be used either individually or in combination of two or more. The oiliness agents adhere to the friction surface of machines, and not only improve friction and wear properties, but also promote lubricity by incorporation with the lubricant additive of the present invention.

The lubricant composition of the present invention may further comprise other additives commonly used for lubricants such as an antioxidant, a metal detergent, an ashless dispersant, an anticorrosive agent, a corrosion inhibitor, a viscosity index improver, a pour point depressant, a rubber swelling agent, a deformer, and a coloring agent. These additives may be added either alone or in combination of two or more.

As the antioxidant, any antioxidants commonly used for lubricants such as a phenolic antioxidant and an amine antioxidant may be used. Specific examples includes alkyl phenols such as 2,6-di-tert-butyl-4-methyl phenol; bisphenols such as methylene-4,4-bis-(2,6-di-tert-butyl-4-methylphenol); naphthylamines such as phenyl-α-naphthylamine; dialkyl diphenylamines; dialkyl zinc dithiophosphate such as di-2-ethylhexyl zinc dithiophosphate; and phenothiazines.

As examples of the metal detergent, an alkaline earth metal sulfonate, an alkaline earth metal phenate, an alkaline earth metal salicylate, and an alkaline earth metal phosphonate can be given.

As examples of the ashless dispersant, alkenyl succinimido, benzylamine, alkyl polyamine, modified compounds of these ashless dispersants with a boron compound or a sulfur compound, and alkenyl succinates can be given.

As examples of the anticorrosive agent, alkenyl succinic acid, alkenyl succinate, polyhydric alcohol ester, petroleum sulfonate, dinonyl naphthalene sulfonate, and the like can be given.

As examples of the corrosion inhibitor, benzotriazole compounds, thiadiazole compounds, imidazole compounds, and the like can be given.

As the viscosity index improver, either a non-dispersant-type viscosity index improver or a dispersant-type viscosity index improver may be used. Specific examples include polymethacrylates, ethylene propylene copolymer, polyisobutylene, polystyrene, and olefin copolymers such as an styrene-diene copolymer can be given.

As the pour point depressant, polymethacrylate polymers conforming to the lubricating base oil can be used.

As examples of the defoaming agent, silicones such as dimethyl silicone and fluorosilicone can be given.

The amount of these commonly-used lubricant additives such as an antioxidant, a metal detergent, an ashless dispersant, an anticorrosive agent, a corrosion inhibitor, a viscosity index improver, a pour point depressant, a rubber swelling agent, a deformer, and a coloring agent are arbitrarily determined. Usually, the amount of the defoamer is 0.0005 to 1 mass %, the amount of the viscosity index improver is 1 to 30 mass %, and the amount of the corrosion inhibitor is 0.005 to 1 mass %. Each of the other additives may be added in an amount of about 0.1 to 15 mass %.

The grease composition of the present invention comprises the lubricant additive of the present invention. That is, the grease composition comprises a rod-like liquid crystal compound possessing a cation group and an anion.

The grease composition of the present invention is produced by mixing the lubricant composition, that is, the lubricant composition containing a rod-like liquid crystal compound possessing a cation group and an anion, and a thickener. Specifically, the grease composition of the present invention consists of the lubricant composition, which contains the lubricant additive of the present invention, and a thickener.

The thickener used in the grease composition of the present invention is not particularly limited. Any thickeners which are used in general grease compositions may be used.

In the grease composition of the present invention, a mixture of the lubricating base oil used in the lubricant composition of the present invention and the thickener is used as a base grease. As the thickener used in the grease composition of the present invention, a soap or a complex soap thickener, an organic soap-free thickener such as a terephthalamate thickener, a urea thickener, polytetrafluoroethylene, and fluorinated ethylene-propylene copolymer, an inorganic soap-free thickener, and the like can be given. These thickeners may be used either individually or in combination of two or more. Although not particularly limited, the thickeners may be used in an amount of preferably 3 to 40 mass %, and more preferably 5 to 20 mass % of the base grease which consists of the lubricating base oil and the thickener. Although not particularly limited, the consistency of the base grease used in the grease composition of the present invention is usually about 100 to 500.

The reason why the lubricant additive of the present invention exhibits the effect of reducing the coefficient of friction in an amount smaller than that required for general liquid crystal compounds is explained taking the case in which the pyridinium salt rod-like liquid crystal compound obtained in Example 2 is added to a lubricant composition. As shown in FIG. 1, the pyridinium salt rod-like liquid crystal compound positively acts on the irregular surface of metal, which functions as one of the factors of increasing the coefficient of friction. The molecules of the rod-like liquid crystal compound efficiently form a membrane on the metal surface vertically and regularly orientating to that surface, thereby efficiently reducing the coefficient of friction on the boundary lubricating area.

The present invention will be described by way of examples, which are not intended to limit the present invention.

EXAMPLES

Example 1

Synthesis of diethyl-2-alkyl malonate (First Step)

Diethyl-2-alkyl malonate (10a) was synthesized according to the following reaction.

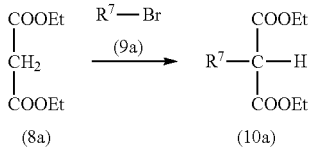

wherein $R^7$ represents n-$C_7H_{15}$ (Example 1) or n-$C_{10}H_{21}$ (Example 2).

A 500 ml erlenmeyer flask was charged with 150 ml of ethanol. After dissolving sodium metal (0.3 mol) in the ethanol, diethyl malonate (8a) (0.3 mol) was added. After cooling, alkyl bromide (9a) (0.3 mol) was added. The mixture was refluxed in an ethylene glycol bath at 30° C. for 18 hours. After removing the solvent by evaporation under reduced pressure, diethyl ether (300 ml) was added and the mixture was washed with 300 ml of cold dilute hydrochloric acid (hydrochloric acid:water=30 ml:300 ml) and 100 ml of cold distilled water in a separating funnel. The ether layer was collected and the water layer was extracted again with 100 ml of diethyl ether. The diethyl ether solution obtained by liquid separation was dehydrated with anhydrous sodium sulfate for about one day. After filtration, diethyl ether was removed under reduced pressure, and the residue was distilled under reduced pressure to obtain diethyl-2-alkyl malonate (10a).

Synthesis of 2-alkyl-1,3-propanediol (Second Step)

2-alkyl-1,3-propanediol (11a) was synthesized according to the following reaction.

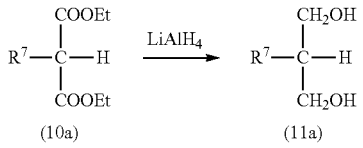

wherein $R^7$ represents n-$C_7H_{15}$ (Example 1) or n-$C_{10}H_{21}$, (Example 2).

A 500 ml round-bottom erlenmeyer flask was charged with 100 ml of diethyl ether and lithium aluminum hydride (twice the number of moles). Then, diethyl-2-alkyl malonate (10a) (0.23 mol) obtained in the first step dissolved in 100 ml of diethyl ether was slowly added using a dropping funnel while cooling with ice. The resulting mixture was refluxed at 40° C.

for four hours in an ethylene glycol bath. After the reaction, a solution of ethyl acetate (0.3 mol) in 100 ml of diethyl ether was slowly added using a dropping funnel while cooling with ice. Next, 50 ml of a saturated ammonium aqueous solution was slowly added drop by drop using a dropping funnel. After that, the flask was filled with diethyl ether and the contents were stirred at room temperature (25° C.) for three hours. The resulting product was filtered and the residue was dissolved in 300 ml of diethyl ether. The solution was stirred for 24 hours. After dehydrating with anhydrous sodium sulfate for about one day, diethyl ether was evaporated under reduced pressure to obtain 2-alkyl-1,3-propanediol (11a) as a residue.

Synthesis of 4-(5-alkyl-1,3-diox-2-yl)pyridine (Third Step)

4-(5-alkyl-1,3-diox-2-yl)pyridine (13a) was synthesized according to the following reaction.

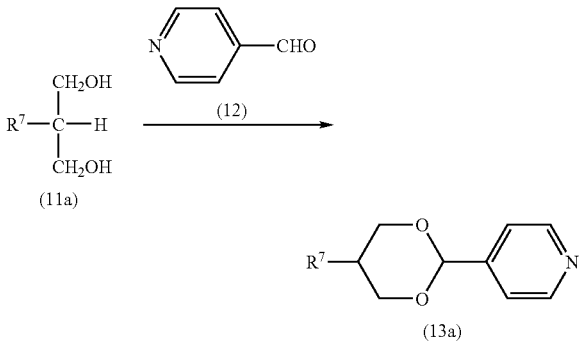

wherein $R^7$ represents n-$C_7H_{15}$ (Example 1) or n-$C_{10}H_{21}$ (Example 2).

A Dean Stark trap was used as a reactor. A 100 ml erlenmeyer flask was charged with benzene (60 ml) and 2-alkyl-1,3-propanediol (11a) (0.03 mol), and pyridine-4-aldehyde (equivalent moles) was dissolved therein. 10 g of p-toluenesulfonic acid was added to reduce the pH to 1 or less. After confirming the pH, the erlenmeyer flask was installed on the Dean Stark trap to reflux the content in a silicone bath at 135 to 140° C. for five hours. After cooling, the reaction product was dissolved in diethyl ether (300 ml), washed with a sodium carbonate aqueous solution (30 g/300 ml) and, after confirming that the aqueous solution was basic, washed with distilled water (100 ml) to obtain a diethyl ether layer. The diethyl ether layer was dehydrated with anhydrous sodium sulfate for about one day. After filtration, diethyl ether was removed under reduced pressure. The residue was purified by column chromatography using silica gel, to which 300 ml of hexane was first fed and then 300 ml of benzene was fed. The target compound was eluted in a benzene solvent. After removing the solvent, the residue was purified by recrystallization three or four times from special grade hexane to obtain 4-(5-alkyl-1,3-diox-2-yl)pyridine (13a).

Synthesis of N-alkyl-4-(5-alkyl-1,3-diox-2-yl)pyridinium bromide (Fourth Step)

N-alkyl-4-(5-alkyl-1,3-diox-2-yl)pyridinium bromide (6a) was synthesized according to the following reaction.

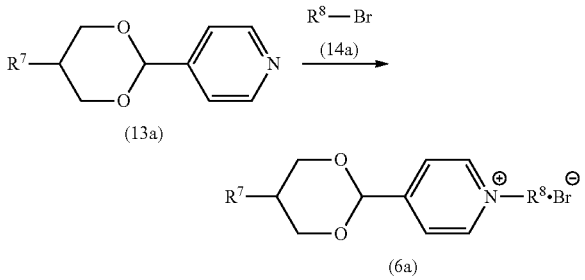

wherein $R^7$ represents n-$C_7H_{15}$ (Example 1) or n-$C_{10}H_{21}$ (Example 2) and $R^8$ represents $C_2H_5$ (Example 1, Example 2).

In a 200 ml round-bottom erlenmeyer flask, the 4-(5-alkyl-1,3-diox-2-yl)pyridine (13a) (0.0017 mol) obtained in the third step and ethyl bromide (10 times mol) were dissolved in 30 ml of special grade acetonitrile and the solution was refluxed at 100° C. for 24 hours on a silicone bath in a nitrogen stream. After removing acetonitrile under reduced pressure, the residue was purified by recrystallization from a mixed solvent of 30 ml of hexane and 30 ml of diethyl ether, followed by washing while stirring for about one day to obtain undissolved components, which were dried under vacuum to obtain N-alkyl-4-(5-alkyl-1,3-diox-2-yl)pyridinium bromide (6a). The results of $^1$H-NMR analysis and IR analysis of the N-alkyl-4-(5-alkyl-1,3-diox-2-yl)pyridinium bromide (6a) are shown in Table 1 and the results of the phase transition temperature measurement are shown in Table 2.

TABLE 1

| | Formula (6a) | Identification data |
|---|---|---|
| Example 1 | $R^7$=$C_7H_{15}$<br>$R^8$=$C_2H_5$ | (1) $^1$H-NMR ($CDCl_3$, δ); 0.85-1.83 (m, 19H), 3.37-4.38 (m, 4H), 5.07 (q, 2H, Jab = 6.70 Hz), 5.48 (s, 1H), 8.08 (d, 2H, Jcd = 6.40 Hz), 9.75 (d, 2H, Jcd = 6.40 Hz)<br>(2) FT-IR ($CHCl_3$, cm − 1); 2920, 2840 (C—H stretching vibration), 1650 (C=C, C=N stretching vibration), 1085 (C—O—C stretching vibration), 890 (pyridine ring C—H out-of-plane bending vibration) |
| Example 2 | $R^7$=$C_{10}H_{21}$<br>$R^8$=$C_2H_5$ | (1) $^1$H-NMR ($CDCl_3$, δ): 0.87-1.85 (m, 25H), 3.38-4.40, (m, 4H), 5.12 (q, 2H, Jab = 6.70 Hz), 5.58 (s, 1H), 8.12 (d 2H, Jcd = 6.40 Hz), 9.78 (d, 2H, Jcd = 6.40 Hz)<br>(2) FT-IR ($CHCl_3$, $cm^{-1}$); 2925, 2870 (C—H stretching vibration), 1655 (C=C, C=N stretching vibration), 1095(C—O—C stretching vibration), 890 (pyridine ring C—H out-of-plane bending vibration) |

TABLE 2

| | Phase transition temperature[1)] |
|---|---|
| Example 1 | Cry $\xleftrightarrow{-9^\circ C.}$ SmA $\xleftrightarrow{30^\circ C.}$ Iso |
| Example 2 | Cry $\xleftrightarrow{-24^\circ C.}$ SmA $\xleftrightarrow{152^\circ C.}$ Iso |

[1)]Cry: Crystal, SmA: Smectic A liquid crystal phase, Iso: isotropic liquid

Examples 3 and 4, Comparative Example 1

Lubricant compositions were obtained by adding the lubricant additive, N-alkyl-4-(5-alkyl-1,3-diox-2-yl)pyridinium bromide (6a) obtained in Example 1 or Example 2, to 2-ethylhexyl sebacate in amounts shown in Table 3. Comparative Example 1 shows an example of only 2-ethylhexyl sebacate without the addition of N-alkyl-4-(5-alkyl-1,3-diox-2-yl)pyridinium bromide (6a).

TABLE 3

| | Additive | Amount added (mass %) |
|---|---|---|
| Example 3 | Example 1 | 0.01 |
| Example 4 | Example 2 | 0.01 |
| Comparative Example 1 | None | 0 |

<Evaluation of Coefficient of Friction>

Figure 2:
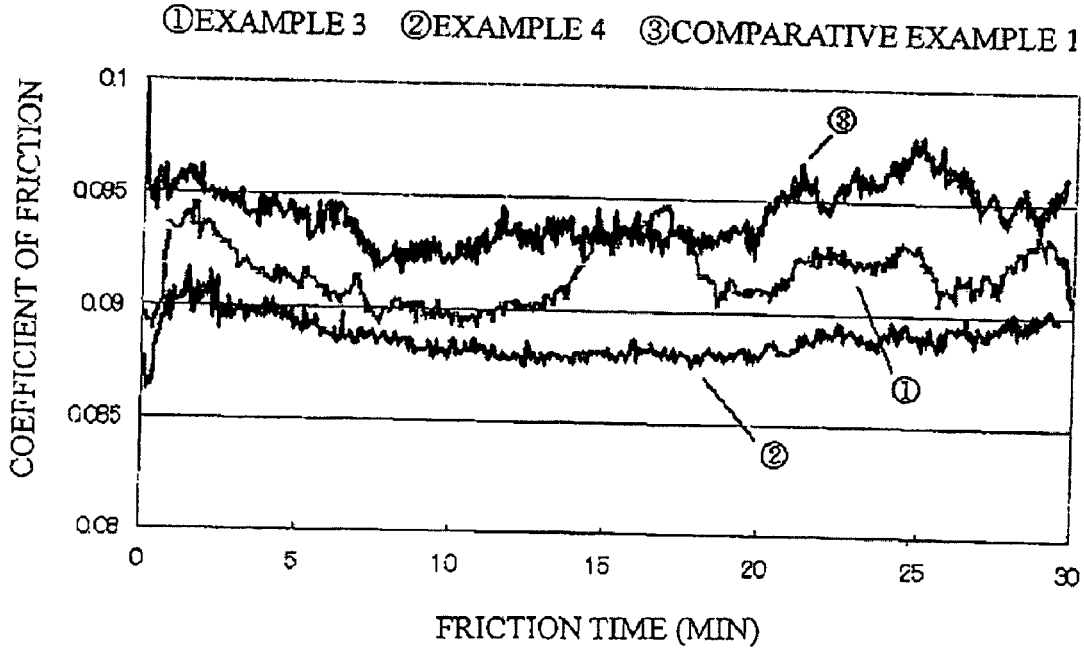

An electroless nickel-plated board of brass was placed on a ball-on plate reciprocal slide tester and two drops of each of the lubricant compositions of Example 3, Example 4, and Comparative Example 1 were dropped on to measure the coefficient of friction by reciprocating under the following conditions. The results of the evaluation are shown in FIG. 2.

Test sample: Electroless nickel-plated board
Friction speed: 10 mm/sec
Friction time: 30 minutes
Reciprocating stroke: 5 mm
Rubbing material: JIS SUJ2 ball, 4.8 mm in diameter
Load: 100 g The lubricant compositions to which the lubricant additive of the present invention was added (Examples 3 and 4) were shown to have a coefficient of friction smaller than the coefficient of friction of the lubricating base oil of Comparative Example 1 to which the additive was not added. Thus, the lubricant additive of the present invention was proven to exhibit an effect of reducing the coefficient of friction. In addition, it was shown that the longer the alkyl chain length of $R^1$, the better the effect of reducing the coefficient of friction (Comparison of Example 3 and Example 4).

Industrial Applicability

According to the present invention, a lubricant additive which can exhibit an effect of reducing the coefficient of friction in a small amount, and a lubricant composition and a grease composition containing the lubricant additive can be obtained. Therefore, high performance lubricant composition and grease composition can be produced at a low cost according to the present invention.

The invention claimed is:

1. A lubricant composition, comprising:

a lubricant additive of a rod-like liquid crystal compound possessing a cation group and an anion, wherein the content of the lubricant additive is 0.0001 to 0.1 mass %, wherein the rod-like liquid crystal compound is 4-(1,3-diox-2-yl)pyridinium salt-type rod-like liquid crystal compound shown by the following formula (6):

(6)

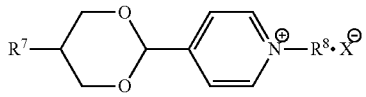

wherein $R^7$ and $R^8$ indicate alkyl groups, alkoxyl groups, or a group having an unsaturated bond shown by the following formula (4), and X represents a halogen atom, (4)

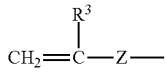

wherein $R^3$ represents a hydrogen atom or a methyl group, Z indicates —$(CH_2)_m$—, —$(CH_2)_m$—O—, —CO—O—$(CH_2)_m$—, —CO—O—$(CH_2)_m$—O—, —$C_6H_4$—$CH_2$—O—, or —CO—, wherein m is an integer of 1 to 30.

2. The lubricant composition according to claim 1, wherein the cation group is a pyridinium group or an ammonium group.

3. The lubricant composition according to claim 1, wherein $R^7$ and $R^8$ in the formula (6) are alkyl groups.

4. The lubricant composition according to claim 3, wherein $R^7$ in the formula (6) is an alkyl group having 8 to 22 carbon atoms and $R^8$ is an alkyl group having 1 to 4 carbon atoms.

5. A grease composition, comprising:

a lubricant additive of a rod-like liquid crystal compound possessing a cation group and an anion, wherein the rod-like liquid crystal compound is 4-(1,3-diox-2-yl)pyridinium salt-type rod-like liquid crystal compound shown by the following formula (6):

(6)

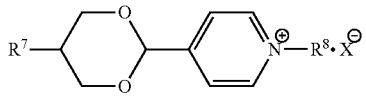

wherein $R^7$ and $R^8$ indicate alkyl groups, alkoxyl groups, or a group having an unsaturated bond shown by the following formula (4), and X represents a halogen atom, (4)

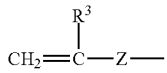

wherein $R^3$ represents a hydrogen atom or a methyl group, Z indicates —$(CH_2)_m$—, —$(CH_2)_m$—O—, —CO—O—$(CH_2)_m$—, —CO—O—$(CH_2)_m$—O—, —$C_6H_4$—$CH_2$—O—, or —CO—, wherein m is an integer of 1 to 30.

6. The grease composition according to claim 5, wherein the content of the lubricant additive is 0.0001 to 0.1 mass %.

7. The grease composition comprising the lubricant composition according to claim 1 and a thickener.

8. The grease composition according to claim 5, wherein $R^7$ and $R^8$ in the formula (6) are alkyl groups.

9. The grease composition according to claim 5, wherein $R^7$ in the formula (6) is an alkyl group having 8 to 22 carbon atoms and $R^8$ is an alkyl group having 1 to 4 carbon atoms.

* * * * *